US010133222B2

(12) United States Patent
Shibuya

(10) Patent No.: US 10,133,222 B2
(45) Date of Patent: Nov. 20, 2018

(54) IMAGE FORMING APPARATUS THAT OBTAINS AN AMOUNT OF APPLIED TONER USING IMAGE DATA BEFORE OR AFTER SCALING, METHOD OF CONTROLLING THE SAME, AND STORAGE MEDIUM

(71) Applicant: CANON KABUSHIKI KAISHA, Tokyo (JP)

(72) Inventor: Yuichiro Shibuya, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/595,992

(22) Filed: May 16, 2017

(65) Prior Publication Data

US 2017/0343943 A1 Nov. 30, 2017

(30) Foreign Application Priority Data

May 24, 2016 (JP) ..... 2016-103616

(51) Int. Cl.
*G03G 15/00* (2006.01)

(52) U.S. Cl.
CPC ..... *G03G 15/50* (2013.01)

(58) Field of Classification Search
None
See application file for complete search history.

(56) References Cited

U.S. PATENT DOCUMENTS 5,459,556 A * 10/1995 Acquaviva ..... G03G 15/08 118/688
6,192,212 B1 * 2/2001 Kunihiro ..... G03G 21/105 399/253
2004/0145757 A1 * 7/2004 Marsden ..... G06K 15/02 358/1.9
2012/0087684 A1 * 4/2012 Sasaki ..... G03G 15/5062 399/53
2016/0110140 A1 * 4/2016 Nagai ..... G06F 3/1229 358/2.1

FOREIGN PATENT DOCUMENTS

JP 2015004738 A 1/2015

* cited by examiner

*Primary Examiner* — Thomas D Lee
(74) *Attorney, Agent, or Firm* — Rossi, Kimms & McDowell LLP

(57) ABSTRACT

An image forming apparatus that, in a case where it is determined that a scaling ratio of the inputted image data does not exceed a predetermined threshold, executes processing for scaling the inputted image and then executes first detection processing that detects an amount of applied toner using image data after scaling, and in a case where it is determined that the scaling ratio of the inputted image data exceeds the predetermined threshold, executes second detection processing that detects the amount of applied toner using the inputted image data prior to scaling and then executes scaling processing after executing the second detection processing.

13 Claims, 13 Drawing Sheets

FIG. 12

| NUMBER | OUTPUT IMAGE SIZE | OUTPUT RESOLUTION | OUTPUT TONE | IMAGE SIZE | RESOLUTION | TONE | SCALING RATIO EXECUTES SCALING PROCESSING AFTER EXECUTING THE SECOND DETECTION PROCESSING. |
|---|---|---|---|---|---|---|---|
| 1 | A4 | 600dpi | 2bit | A4 | 600dpi | 2bit | 1.0 |
| 2 | A4 | 600dpi | 2bit | A4 | 300dpi | 2bit | 4.0 |
| 3 | A4 | 600dpi | 2bit | A3 | 600dpi | 2bit | 0.5 |

IMAGE FORMING APPARATUS THAT OBTAINS AN AMOUNT OF APPLIED TONER USING IMAGE DATA BEFORE OR AFTER SCALING, METHOD OF CONTROLLING THE SAME, AND STORAGE MEDIUM

BACKGROUND OF THE INVENTION

Field of the Invention

The present invention relates to a technique that enables a reduction of power consumption and high speed printing in an image forming apparatus that thermally fixes a toner image formed by an electrophotographic method onto a transfer sheet.

Description of the Related Art

In recent years, market demand has been rising for energy saving and high-speeds in relation to OA devices such as printers and copying machines. In an image forming apparatus that thermally fixes a toner image formed by an electrophotographic method onto a transfer sheet, improvements in power consumption and fixing speed in a fixing apparatus are important in achieving such capabilities. Normally, the fixing temperature and fixing speed of a fixing apparatus are decided considering a maximum amount of color material (hereinafter referred to as "amount of applied toner") that can be applied on a transfer sheet, in order to attain a stable fixing characteristic. In full color copying machines, there is a tendency for the amount of color material applied on the transfer sheet to be greater because image formation is performed by overlapping a plurality of color materials such as CMYK (cyan, magenta, yellow, and black). Also, because the amount of applied toner is closely related to a region in which the image forming apparatus can represent color (hereinafter referred to as a color reproduction region), a sufficient amount of applied toner is needed to maintain high image quality. However, if the amount of applied toner is large, a high fixing temperature or a long fixing time is required; the former increases power consumption while the latter decreases printing speed. Accordingly, the fixing temperature and the fixing speed of the fixing apparatus are changed in accordance with a maximum amount of applied toner for an image. In Japanese Patent Laid-Open No. 2015-4738, a technique in which high speed printing is performed while controlling a fixing apparatus in accordance with the amount of applied toner by omitting or simplifying detection of a maximum amount of applied toner from a second time in a case when the same image is printed a plurality of times is proposed.

However, there is a problem as described below in the foregoing conventional technique. For example, in the foregoing conventional technique, there is a problem in that high-speed printing cannot be performed in the case of an image forming apparatus in which image processing and amount of applied toner detection itself take a long time. In an image forming apparatus in which detection of the amount of applied toner is realized in software, time for detecting the amount of applied toner is proportional to the size of the image, and therefore a decrease in the printing speed is noticeable if a large image is printed. For example, even in the case of image data of a low resolution, if the image is magnified and then output, the amount of applied toner is detected using the magnified image data, and the time for detection depends on the image data at the time of image output.

SUMMARY OF THE INVENTION

The present invention enables realization of a mechanism for efficiently performing fixing control by predicting an amount of applied toner after magnification using data prior to a magnification of image data in image processing.

One aspect of the present invention provides an image forming apparatus, comprising: a memory device that stores a set of instructions; and at least one processor that executes the instructions to: determine whether or not a scaling ratio for a time of processing inputted image data exceeds a predetermined threshold, and in a case where it is determined that the scaling ratio of the inputted image data does not exceed the predetermined threshold, execute processing for scaling the inputted image and then execute first detection processing that detects an amount of applied toner using image data after scaling, and in a case where it is determined that the scaling ratio of the inputted image data exceeds the predetermined threshold, execute second detection processing that detects the amount of applied toner using the inputted image data prior to scaling and then execute scaling processing after executing the second detection processing.

Another aspect of the present invention provides a method of controlling an image forming apparatus, the image forming apparatus comprising a memory device that stores a set of instructions; and at least one processor that executes the instructions, the method comprising: determining whether or not a scaling ratio for a time of processing inputted image data exceeds a predetermined threshold, and in a case where it is determined that the scaling ratio of the inputted image data does not exceed the predetermined threshold, executing processing for scaling the inputted image and then executing first detection processing that detects an amount of applied toner using image data after scaling, and in a case where it is determined that the scaling ratio of the inputted image data exceeds the predetermined threshold, executing second detection processing that detects the amount of applied toner using the inputted image data prior to scaling and then executing scaling processing after executing the second detection processing.

Still another aspect of the present invention provides a non-transitory computer readable storage medium for storing a program for causing a computer to execute each step of a method of controlling an image forming apparatus, the image forming apparatus comprising a memory device that stores a set of instructions; and at least one processor that executes the instructions, the method comprising: determining whether or not a scaling ratio for a time of processing inputted image data exceeds a predetermined threshold, and in a case where it is determined that the scaling ratio of the inputted image data does not exceed the predetermined threshold, executing processing for scaling the inputted image and then executing first detection processing that detects an amount of applied toner using image data after scaling, and in a case where it is determined that the scaling ratio of the inputted image data exceeds the predetermined threshold, executing second detection processing that detects the amount of applied toner using the inputted image data prior to scaling and then executing scaling processing after executing the second detection processing.

Further features of the present invention will be apparent from the following description of exemplary embodiments with reference to the attached drawings.

BRIEF DESCRIPTION OF THE DRAWINGS

FIG. 12 is a view illustrating a table related to scaling ratios according to an embodiment.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

<System Configuration>

Figure 1:
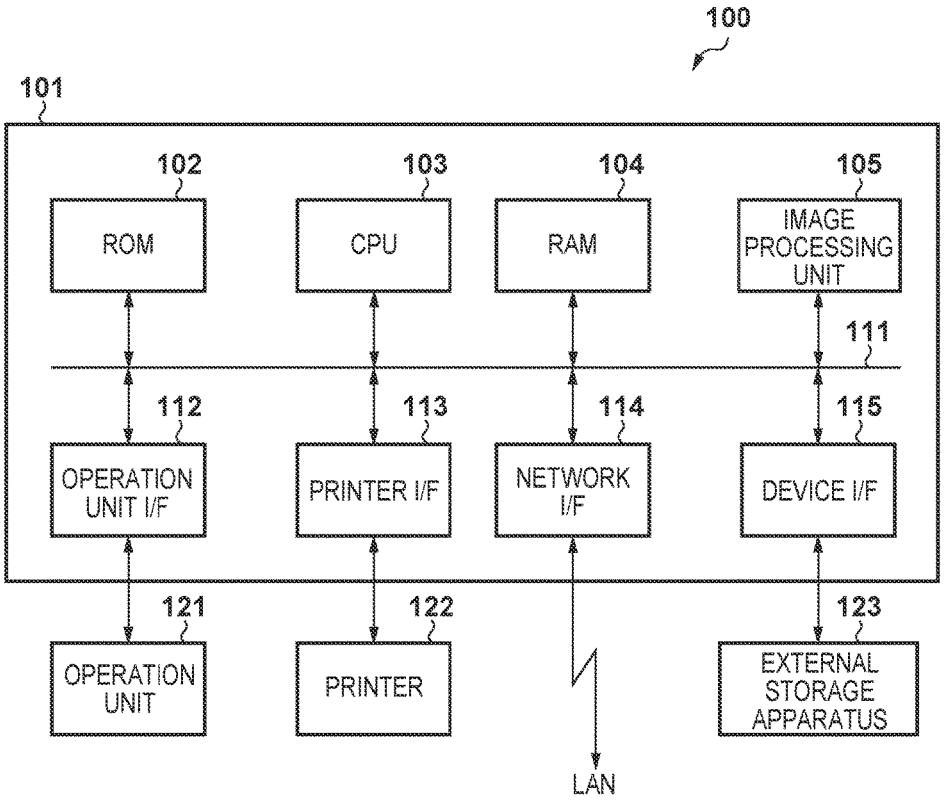
FIG. 1 is a view illustrating a system configuration of an image forming apparatus according to an embodiment.

Hereinafter, preferred embodiments for working the present invention are described using drawings. Firstly, with reference to FIG. 1, a system configuration of an image forming apparatus 100 according to an embodiment of the present invention will be described. The image forming apparatus 100 according to the present invention is a color or monochrome electrophotographic image forming apparatus that uses toner such as, for example, a digital electrophotographic copying machine, a laser printer, a facsimile machine or the like.

The image forming apparatus 100 is comprised by a controller 101 and a plurality of external components (an operation unit 121, a printer 122, and an external storage apparatus 123). The controller 101 comprises a ROM 102, a CPU 103, a RAM 104, and an image processing unit 105.

The CPU 103 is a central processing unit (processor) that comprehensively performs control of the apparatus as a whole and arithmetic processing, and executes each process described later based on programs stored in the ROM 102. The ROM 102 is a read-only memory, and is a storage region for a system boot program, programs that control a printer engine, character data, character code information, and the like. The RAM 104 is a random-access memory, and is a data storage region with no use limitation. The RAM 104 is used as a storage region for registered font data added by download, or as an execution region for data and programs for each of a variety of processes. Also, the RAM 104 can be used as a data storage region for a received image file. The image processing unit 105 performs image data generation processing.

The operation unit 121 performs, for example, displaying by a liquid crystal display or the like, and is used to display a setting state of the apparatus, current processes within the apparatus, error statuses or the like. Also, it is used to perform image formation setting changes or resetting. The printer 122 is a part that controls each apparatus (a fixing apparatus and the like) of a printer engine. The external storage apparatus 123 is a storage medium (for example, an SD card), and is used for data spooling, storage of programs, information files/image data, or the like, and as a work region.

The controller 101 further comprises various interfaces (I/Fs) and a system bus 111. An operation unit I/F 112 is connected to the operation unit 121. A printer I/F 113 performs control with the printer 122 for supplying data. A network I/F 114 connects the image forming apparatus 100 to a network (for example, a LAN). A device I/F 115 connects with the external storage apparatus 123. The system bus 111 is a data path between the foregoing structural elements.

<Image Processing Unit Configuration>

Figure 2:
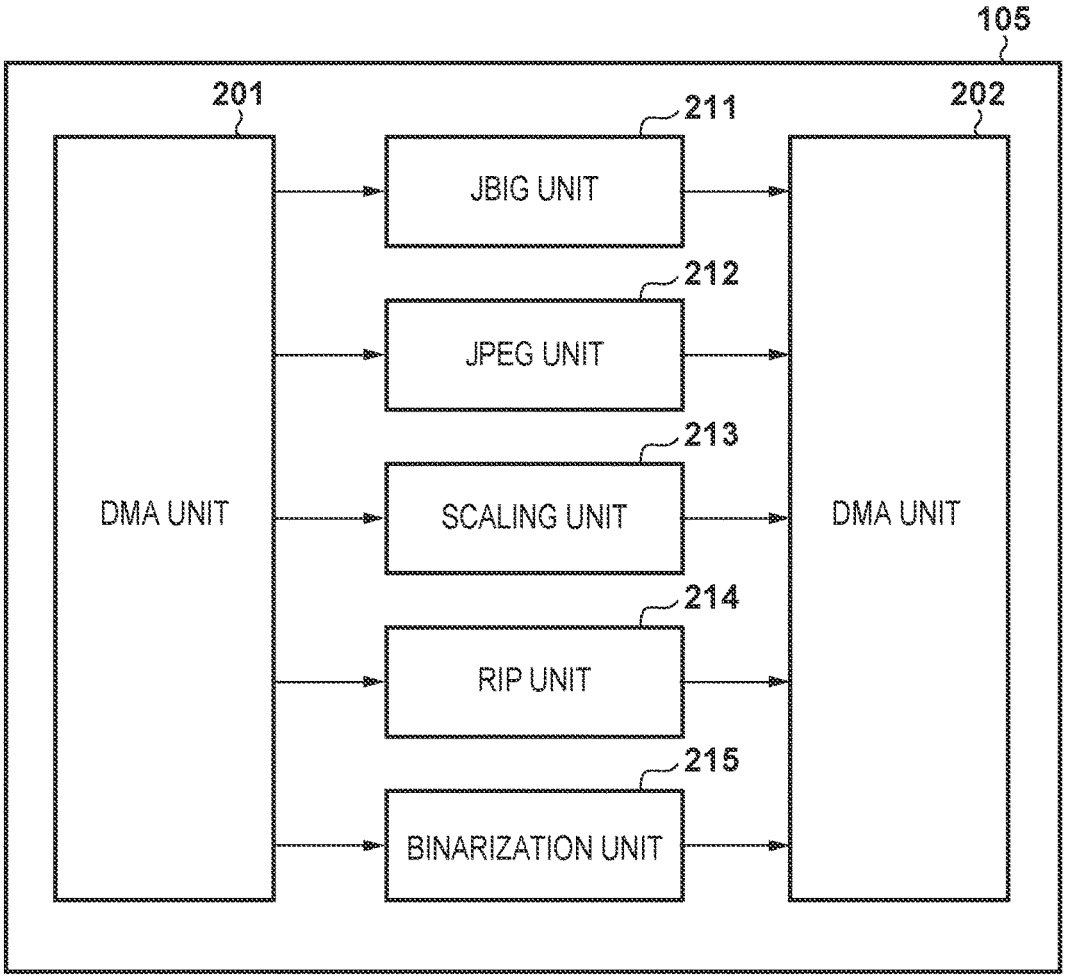
FIG. 2 is a block diagram illustrating a configuration of an image processing unit according to an embodiment.

Next, with reference to FIG. 2, a configuration of the image processing unit 105 according to an embodiment will be described. The image processing unit 105 comprises DMA units 201 and 202, a JBIG unit 211, a JPEG unit 212, a scaling unit 213, an RIP unit 214, and a binarization unit 215.

The DMA unit 201 inputs data from hardware connected to the system bus 111, and based on values set in the DMA unit 201 in advance, outputs data to the JBIG unit 211, the JPEG unit 212, the scaling unit 213, the RIP unit 214, and the binarization unit 215. The JBIG unit 211 performs a JBIG decompression of JBIG-compressed image data that was inputted from the DMA unit 201, and outputs the result to the DMA unit 202. Alternatively, it performs a JBIG compression of bitmap format image data inputted from the DMA unit 201 and outputs the result to the DMA unit 202.

The JPEG unit 212 performs a JPEG decompression of JPEG-compressed image data that was inputted from the DMA unit 201, and outputs the result to the DMA unit 202. Alternatively, it performs a JPEG compression of bitmap format image data inputted from the DMA unit 201 and outputs the result to the DMA unit 202.

The scaling unit 213 performs magnification or reduction, based on a value set in the scaling unit 213 in advance, on bitmap format image data inputted from the DMA unit 201 and outputs the result to the DMA unit 202. The RIP unit 214 generates bitmap format image data, based on a value set in the RIP unit 214 in advance, in relation to intermediate data generated from PDL data inputted from the DMA unit 201, and outputs the result to the DMA unit 202. The binarization unit 215 generates binary bitmap format image data, based on a value set in the binarization unit 215 in advance, on multi-value bitmap format image data inputted from the DMA unit 201, and outputs the result to the DMA unit 202.

The DMA unit 202 outputs data inputted from the JBIG unit 211, the JPEG unit 212, the scaling unit 213, the RIP unit 214, and the binarization unit 215 to hardware connected to the system bus 111 based on a value set in the DMA unit 202 in advance.

<Image Formation Processing>

Figure 3:
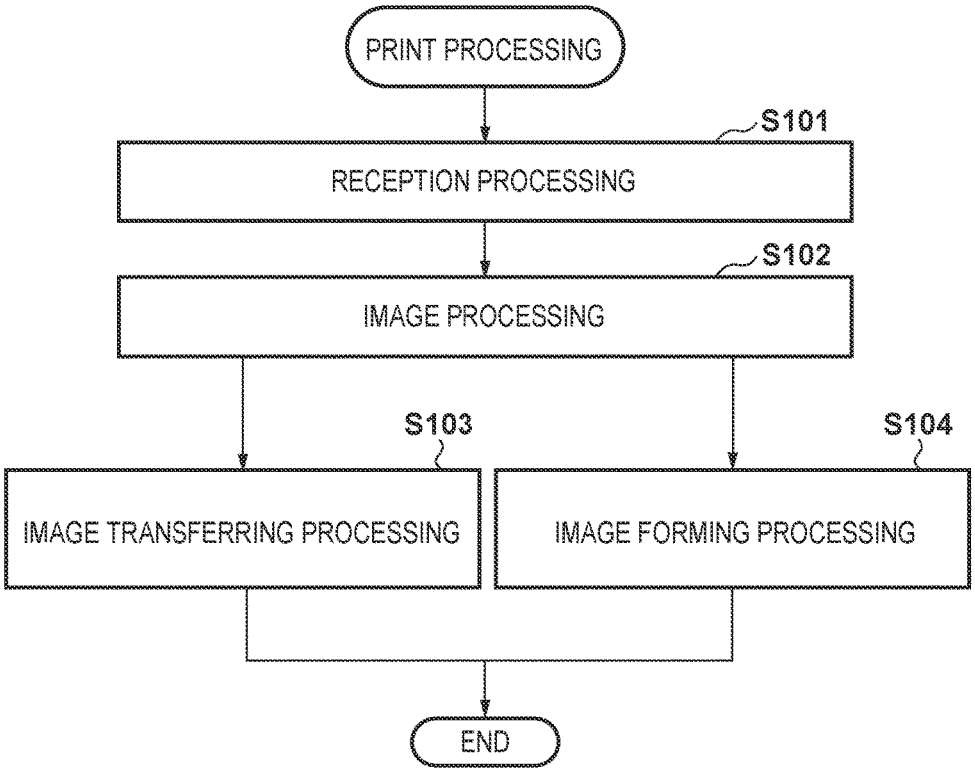
FIG. 3 is a flowchart illustrating image formation processing according to an embodiment.

Next, with reference to FIG. 3, a processing procedure for image formation processing according to an embodiment will be described. The processing described below is realized by the CPU 103 reading a control program stored in the ROM 102 or the external storage apparatus 123 into the RAM 104 and executing it. Note that in the description of the flowcharts below, "S . . . " represents a step.

Firstly, in step S101, the CPU 103 receives input image data using the network I/F 114. The CPU 103 obtains read-in input image data and image forming information for an image from a header of the image data, and saves the obtained input image data and image forming information in the external storage apparatus 123.

Next, in step S102, the CPU 103, using the image processing unit 105, generates output image data for transfer to the printer 122 from the image forming information and input image data held on the external storage apparatus 123, and saves the generated output image data in the external storage apparatus 123. In step S103, the CPU 103 performs an image forming instruction via the printer I/F 113 to the printer 122. Then, the CPU 103 temporarily saves on the RAM 104 the output image data saved in the external storage apparatus 123, and thereafter transfers it to the printer 122 via the printer I/F 113.

Meanwhile, in step S104, the printer 122 receives an image forming instruction via the printer I/F 113 from the CPU 103, and performs control of the fixing temperature/fixing speed of the fixing apparatus. Next, the printer 122 receives image data via the printer I/F 113 from the CPU 103, and executes image formation processing by performing image formation control for forming an image on a recording material and sheet conveyance control.

<Image Processing>

Figure 4:
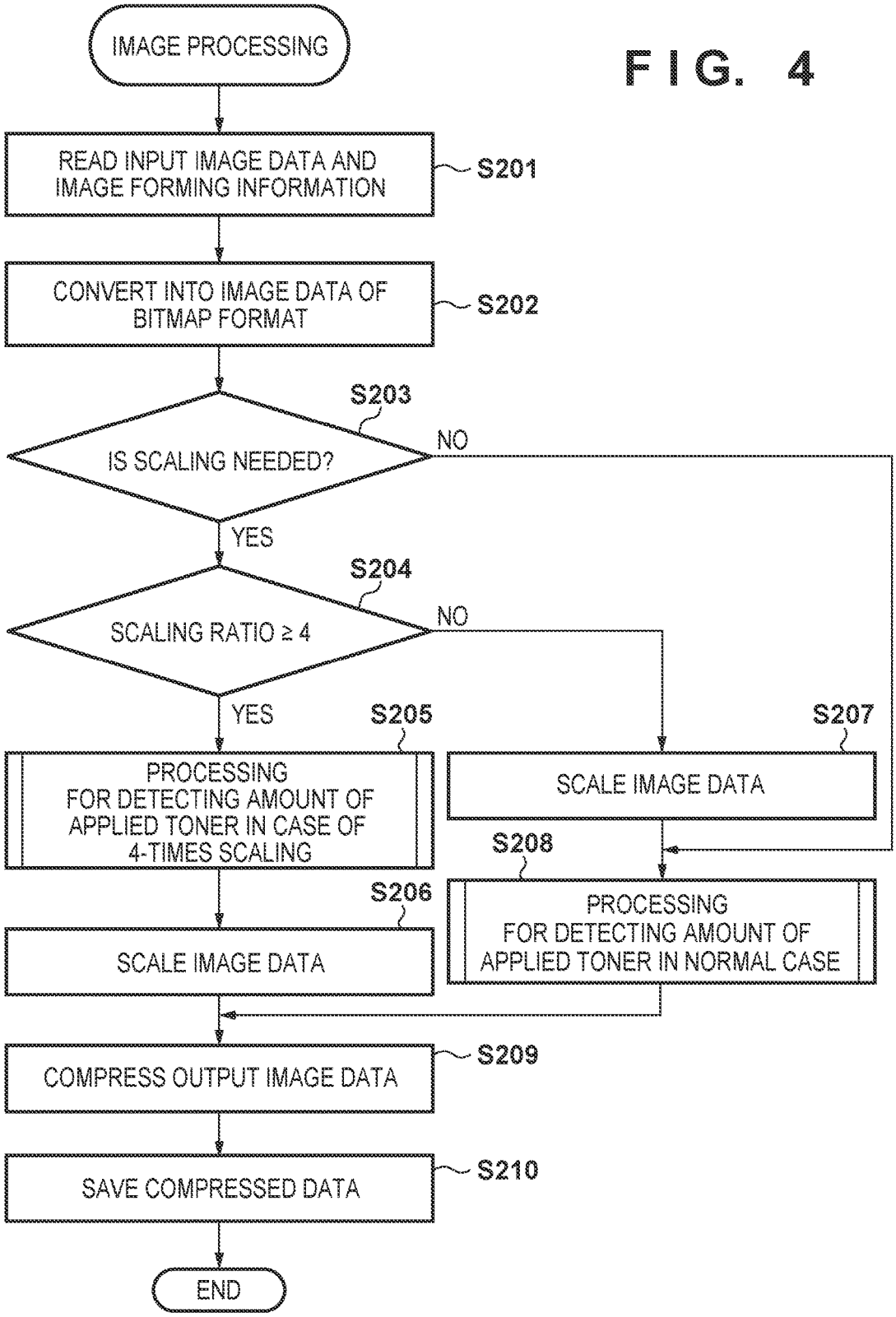
FIG. 4 is a flowchart illustrating image processing according to an embodiment.

Next, with reference to FIG. 4, a processing procedure for image processing according to the present embodiment is described. The processing described below is realized by the CPU 103 reading a control program stored in the ROM 102 or the external storage apparatus 123 into the RAM 104 and executing it. Each image process is executed by the image processing unit 105 in accordance with an instruction by the CPU 103.

Figure 7:
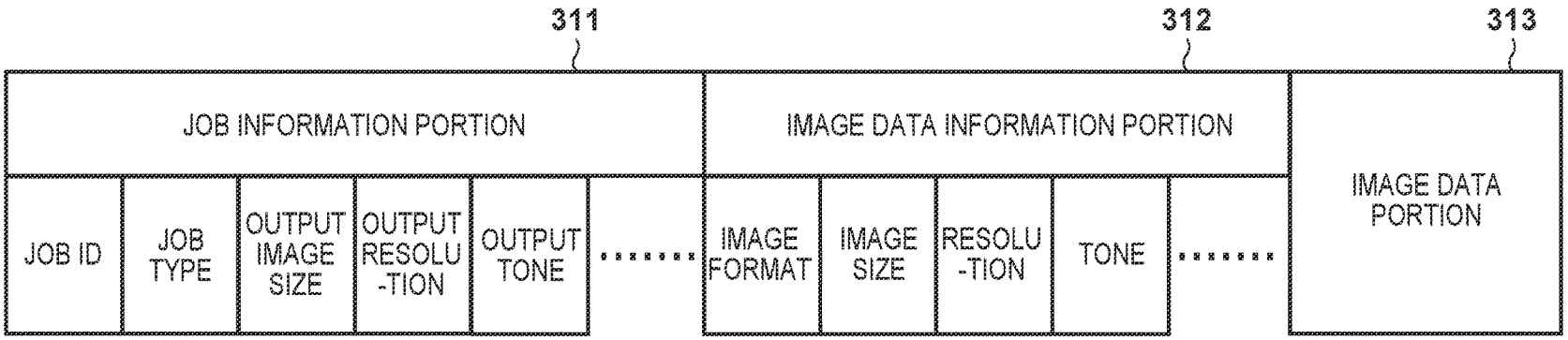
FIG. 7 is a view illustrating a data configuration of received input image data according to an embodiment.

Firstly, in step S201, the CPU 103 obtains input image data saved in the external storage apparatus 123, and saves the obtained image forming information in the RAM 104. Here, the input image data is described with reference to FIG. 7. The input image data is configured to include a job information portion 311, an image data information portion 312, and an image data portion 313. In the job information portion 311, setting values for image formation such as an output image size, an output resolution, an output tone are stored. The main image data is stored in the image data portion 313. In the image data information portion 312, information of the main image data stored in the image data portion 313 such as an image format, an image size, a resolution, and a tone is stored.

The description of FIG. 4 is returned to. In step S202, the CPU 103, based on the information of the image data information portion 312 saved in the RAM 104, converts the input image data into image data of a bitmap format using the image processing unit 105. For example, if the image format of the image data information is JPEG, input image data is inputted into the JPEG unit 212 via the DMA unit 201 from the RAM 104. The JPEG unit 212 converts the JPEG-compressed image data that was inputted from the DMA unit 201 into bitmap format image data by JPEG decompression, and outputs the result to the DMA unit 202. The DMA unit 202 saves image data outputted from the JPEG unit 212 in the RAM 104.

In step S203, the CPU 103 obtains a scaling ratio from the output image size, the output resolution, and the output tone of the job information portion 311 and the image size, the resolution, and the tone of the image data information portion 312 in the input image data saved in the RAM 104. For example, in the case of the number 1 combination of FIG. 12, the scaling ratio is 1.0, for the number 2 combination the scaling ratio is 4.0, and for the number 3 combination it is 0.5. Since the scaling ratio is 1.0 for the number 1 combination, scaling is not necessary, and so the processing proceeds to step S208. Meanwhile, in the case of the number 2 or number 3 combinations, the scaling ratio is not 1.0, it is determined that scaling is necessary, and the processing proceeds to step S204.

In step S204, the CPU 103 determines whether or not the scaling ratio obtained in step S203 is greater than or equal to a predetermined threshold, for example, 4.0. If the job information portion 311 and the image data information portion 312 of the input image data are the number 2 combination of FIG. 12, the scaling ratio is 4.0, and so the processing proceeds to step S205. Meanwhile, in the case of the number 3 combination of FIG. 12, the scaling ratio is 0.5, and so the processing proceeds to step S207. Note that 4.0 is described as an example of a branching threshold, but the intention is not to limit the present invention, and any numerical value can be used.

In step S205, the CPU 103 performs a process for detecting an amount of applied toner in a case of 4-times scaling (second detection processing) on the pre-scaling bitmap format image data which is stored on the RAM 104. The process for detecting the amount of applied toner is processing that uses image data to predict the amount of applied toner in advance in order to decide a fixing temperature of a time of image formation, for example. That is, it is processing for deriving an amount of applied toner from the image data, and in particular a maximum amount of applied toner for an image to be formed, at a time of image processing prior to image formation without measuring the amount of applied toner using an optical sensor or the like after actually forming the image. Details of the processing of step S205 will be described later using FIGS. 5A-5B, and FIGS. 6A-6B. Next, in step S206, the CPU 103 performs scaling on the image data in the bitmap format stored on the RAM 104, based on the scaling ratio obtained in step S203. In the scaling processing, input image data is inputted into the scaling unit 213 via the DMA unit 201 of the image processing unit 105 from the RAM 104. The scaling unit 213 scales, based on a scaling ratio set in advance, the bitmap format image data inputted from the DMA unit 201 and outputs the result to the DMA unit 202. The DMA unit 202 saves the image data outputted from the scaling unit 213 in the RAM 104.

Meanwhile, if it is determined that the scaling ratio is less than 4.0, the CPU 103 in step S207 performs similar scaling to step S206. After that, in step S208, the CPU 103 performs a process for detecting an amount of applied toner in a normal case (first detection processing) on the bitmap format image data prior to scaling stored on the RAM 104. Details of the processing of step S208 will be described later using FIGS. 5A-5B, and FIGS. 6A-6B. In this way, if it is determined that scaling is necessary in step S203 and the scaling ratio is less than 4.0 in step S204, normal detection of the amount of applied toner is performed in relation to the bitmap format the image data after scaling. That is, configuration is such that the scaling processing is performed prior to this processing for more accurate processing for detecting the amount of applied toner, based on the prediction that the processing time will not increase significantly because the variation in the data size will be relatively small even after scaling.

In step S209, the CPU 103 performs JBIG-compression of the bitmap format image data stored on the RAM 104. In JBIG compression processing, bitmap-format image data is inputted into the JBIG unit 211 via the DMA unit 201 of the image processing unit 105 from the RAM 104. The JBIG unit 211 performs a JBIG compression on bitmap format image data inputted from the DMA unit 201 and outputs the result to the DMA unit 202. The DMA unit 202 saves the compressed image data outputted from the JBIG unit 211 in the RAM 104. In step S210, the CPU 103 saves the compressed image data on the RAM 104 into the external storage apparatus 123, and ends the processing.

<Processing for Detecting the Amount of Applied Toner>

Figure 5A:
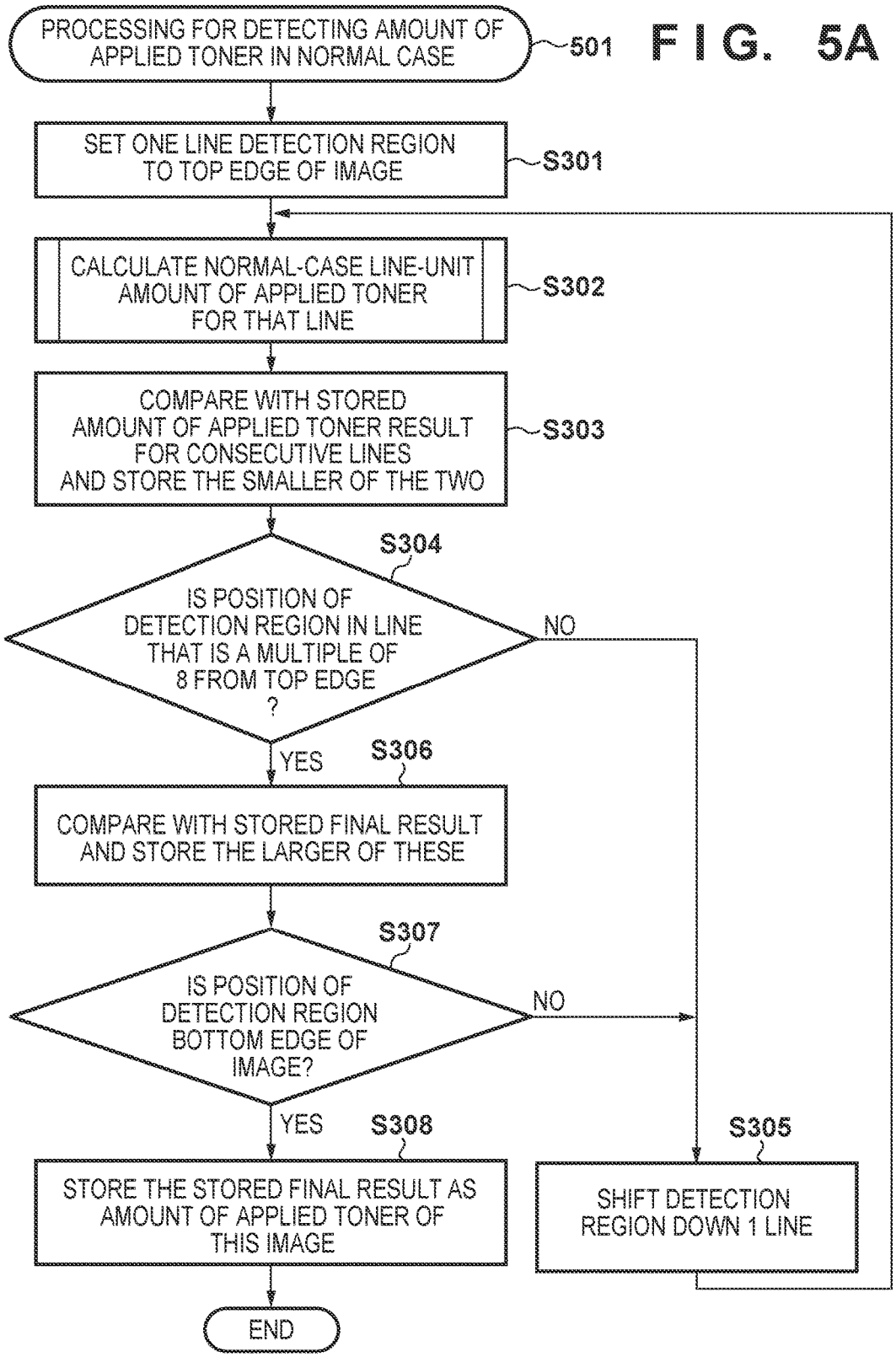
FIGS. 5A and 5B are flowcharts illustrating amount of applied toner detection processing according to an embodiment.
Figure 5B:
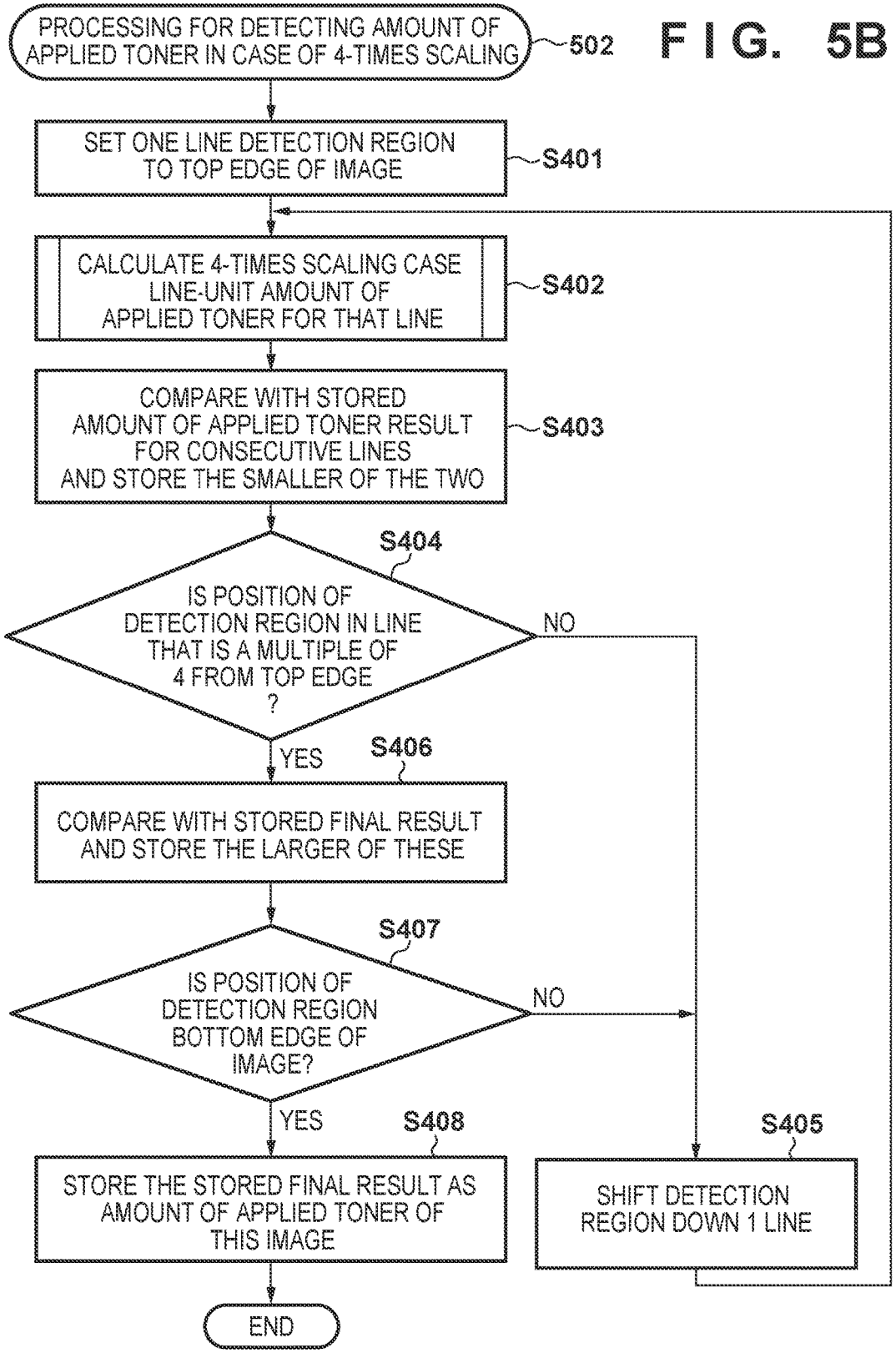

Next, with reference to FIGS. 5A and 5B, a processing procedure for processing for detecting the amount of applied toner according to an embodiment will be described. The process for detecting the amount of applied toner, as described above, is processing for obtaining the amount of applied toner (for example, a maximum value thereof) of the image to be formed from image data at a time of image processing prior to image formation. The processing described below is realized by the CPU 103 reading a control program stored in the ROM 102 or the external storage apparatus 123 into the RAM 104 and executing it. Firstly, a flowchart 501 illustrating processing for detecting the amount of applied toner (step S208) in a normal case according to an embodiment will be described.

Figure 8:
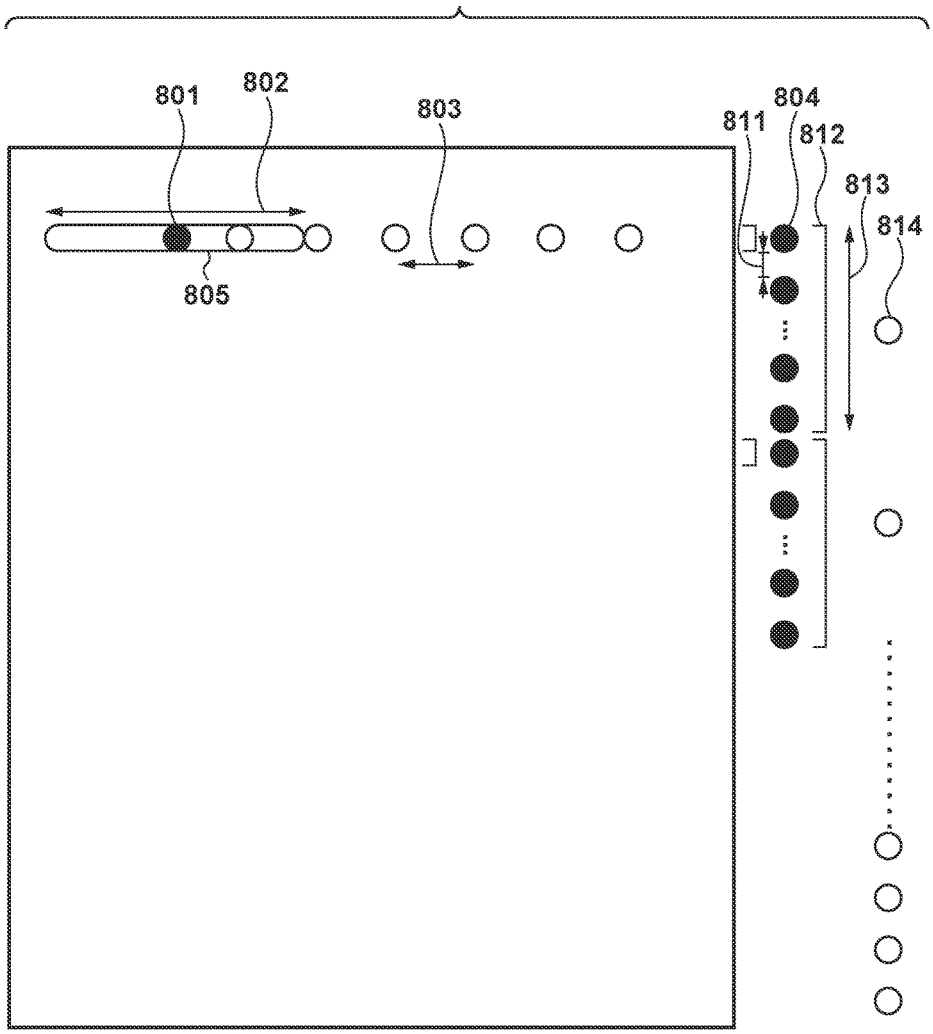
FIG. 8 is a view for describing amount of applied toner detection processing according to an embodiment.

In step S301, the CPU 103 sets a one-line detection region to a top edge of the image in the inputted bitmap-format image data. Here, the detection region indicates a region for which the amount of applied toner is to be detected. In step S302, the CPU 103 obtains the normal-case line-unit amount of applied toner for the line set as the detection region. Here, the amount of applied toner in the line set as the detection region, for example, the maximum value is obtained. The process for detecting the normal-case line-unit amount of applied toner is described later using FIGS. 6A-6B. FIG. 8 is a view for describing processing for detecting the amount of applied toner according to an embodiment. White circles and black circles indicate pixels of each line. Reference numeral 802 denotes a width of a detection region 805. Reference numeral 811 of FIG. 8 represents the normal-case line-unit amount of applied toner.

In step S303, the CPU 103 compares the line-unit amount of applied toner obtained in step S302 and a consecutive lines result stored in the RAM 104, and overwrites in the RAM 104 with the smaller of these as a new consecutive lines result. If no value is held for the consecutive lines result, the line-unit amount of applied toner obtained in step S302 is saved in the RAM 104 as the new consecutive lines result. As denoted by reference numeral 812 of FIG. 8, the minimum value of the amount of applied toner of 8 consecutive lines is made to be the consecutives line result 813.

In step S304, the CPU 103 determines whether or not the position of detection region is in a line that is at a multiple of 8 counting from the top edge. If it is in a line that is a multiple of 8, the processing proceeds to step S306, and if it is in a line that is not a multiple of 8, proceeds to step S305. In step S305, the CPU 103 shifts the detection region down one line, and returns the processing to step S302.

Meanwhile, in step S306, the CPU 103 compares the consecutive lines result stored in the RAM 104 and a final result stored in the RAM 104 and overwrites in the RAM 104 with the larger of the two as the new final result. If no value is held as the final result, the CPU 103 saves the consecutive lines result in the RAM 104 as the new final result. It is desirable to make the maximum value in the consecutive lines result be the final result of the amount of applied toner, as denoted by reference numeral 814 of FIG. 8. Note that, in step S306, the CPU 103 preferably clear the consecutive lines result stored in the RAM 104.

In step S307, the CPU 103 determines whether or not the position of detection region is the bottom edge of the image. If it is the bottom edge, the processing proceeds to step S308, and if it is not the bottom edge, the processing proceeds to step S305. In step S308, the CPU 103 saves in the RAM 104 the final result that is saved in the RAM 104 as the amount of applied toner for the image, and ends the processing.

Next, a flowchart 502 illustrating processing for detecting the amount of applied toner (step S205) in a case of 4-times scaling according to an embodiment will be described. There are differences in step S402 and step S404 as compared to the normal-case amount of applied toner detection processing. Accordingly, only these differences will be described.

In step S402, the CPU 103 obtains the 4-times scaling line-unit amount of applied toner for the line set as the detection region. The process for detecting the 4-times scaling line-unit amount of applied toner is described later using FIGS. 6A-6B.

In step S404, the CPU 103 determines whether or not the position of detection region is in a line that is at a multiple of 4 counting from the top edge. If it is, the processing proceeds to step S406, and if not, the processing proceeds to step S405. Because other steps are the same as in the normal-case amount of applied toner detection processing, description is omitted.

Figure 6A:
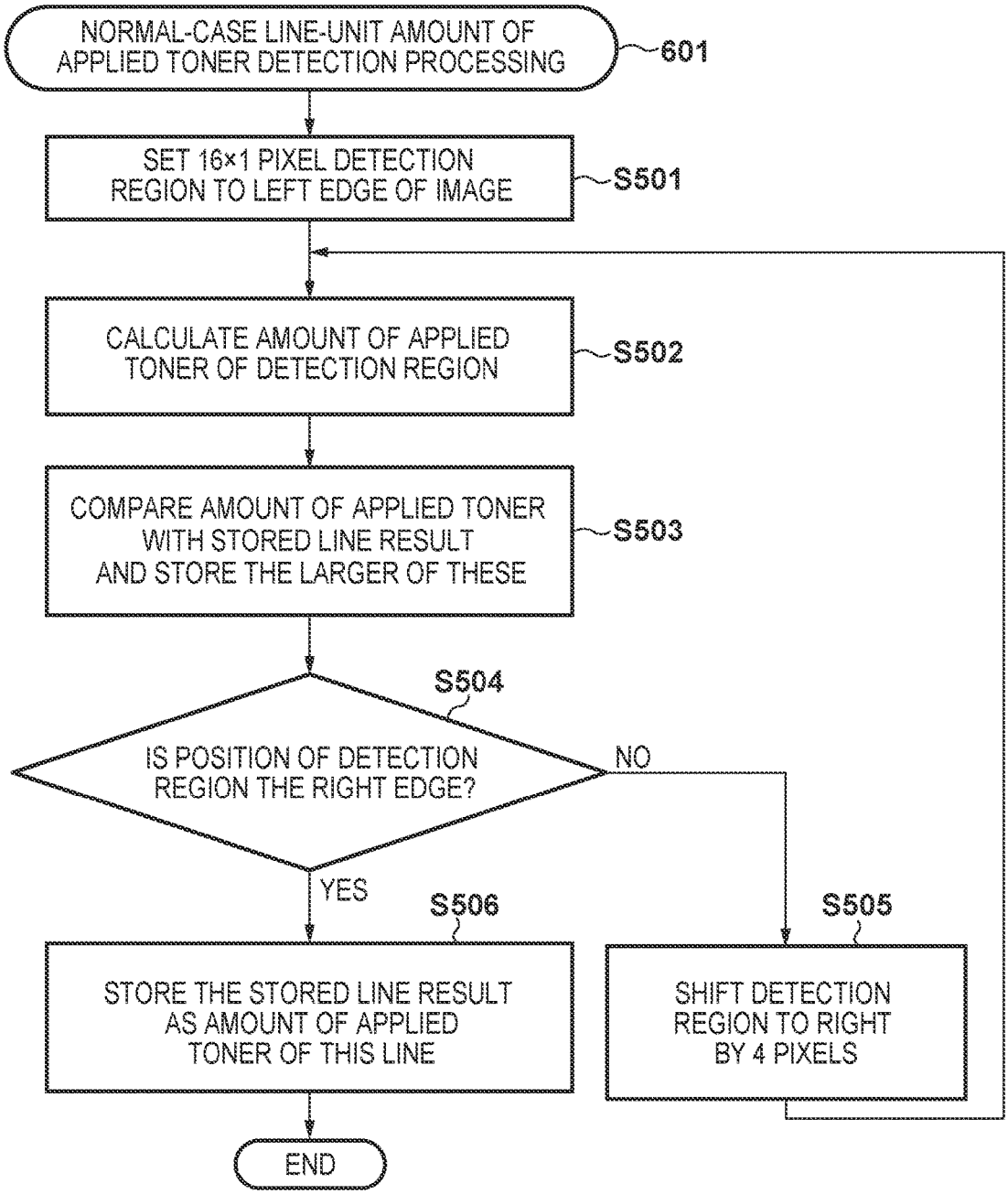
FIGS. 6A and 6B are flowcharts illustrating processing for detecting a line-unit amount of applied toner according to an embodiment.
Figure 6B:
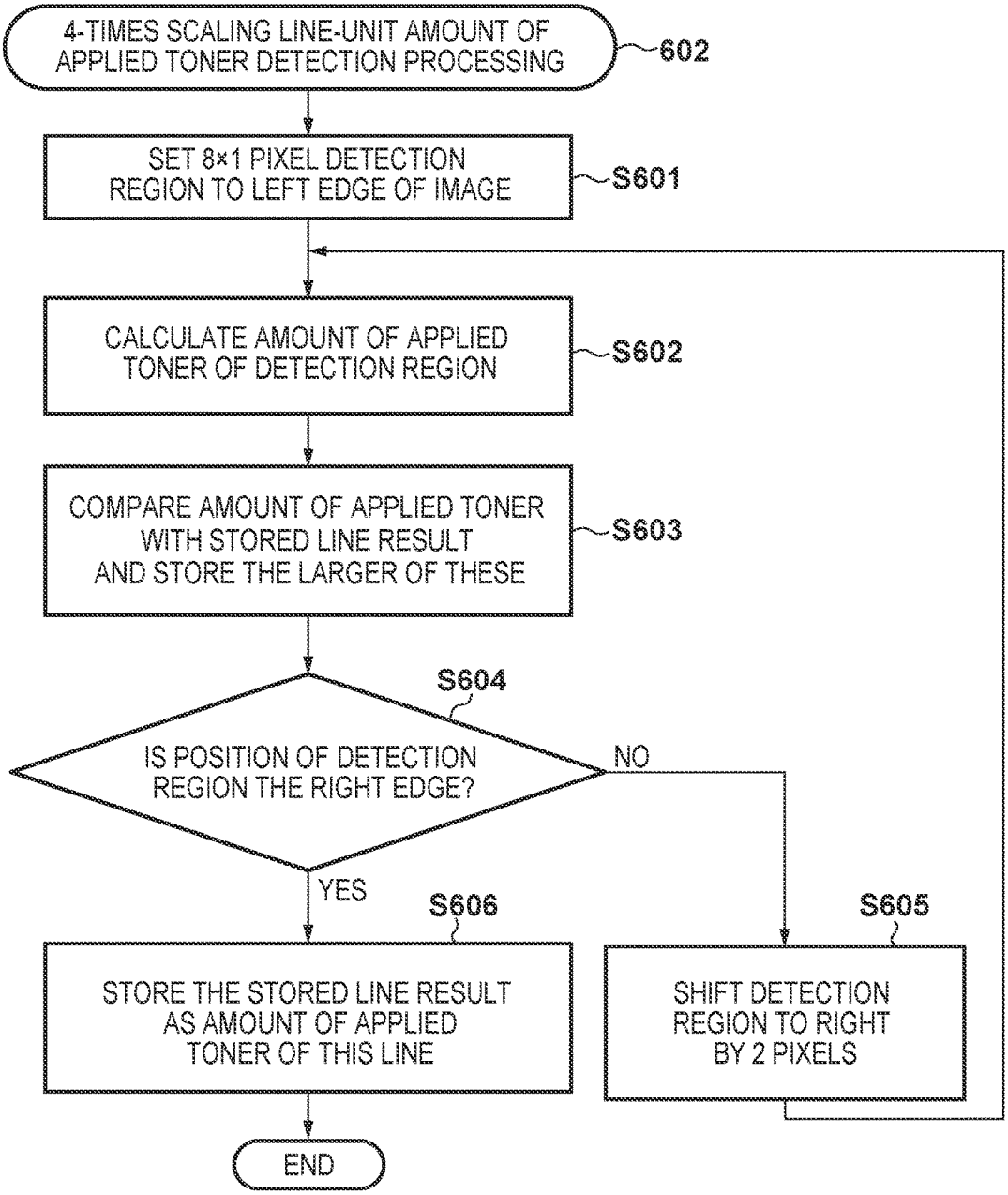

Next, with reference to FIGS. 6A-6B, a processing procedure for processing for detecting the amount of applied toner for a line-unit according to an embodiment will be described. The processing described below is realized by the CPU 103 reading a control program stored in the ROM 102 or the external storage apparatus 123 into the RAM 104 and executing it. Firstly, a flowchart 601 illustrating processing for detecting the amount of applied toner (step S302) in a normal case according to an embodiment will be described.

Firstly, in step S501, the CPU 103 sets a 16×1 pixel detection region 805 to a left edge of the image in an image corresponding to the inputted bitmap-format image data. As illustrated in FIG. 8, the detection region 805 is set with the width of reference numeral 802, and a representative value thereof is made to be reference numeral 801.

In step S502, the CPU 103 obtains the normal-case amount of applied toner for the pixel group set as the detection region. For example, a total of the density values of each color is obtained for each pixel, and the total of the largest density value in the pixels in the detection region is made to be the amount of applied toner. Next, in step S503, the CPU 103 compares the amount of applied toner (maximum value) obtained in step S502 and a line result stored in the RAM 104, and overwrites in the RAM 104 with the larger of these as a new consecutive lines result. If no value is held for the line result, the CPU 103 saves the amount of applied toner obtained in step S502 in the RAM 104 as the new lines result. The maximum value in the line result illustrated by reference numeral 803 of FIG. 8 is made to be the amount of applied toner of this line.

In step S504, the CPU 103 determines whether or not the position of detection region is at the right edge of the image.

If it is at the right edge, the processing proceeds to step S506, and if it is not the right edge, the processing proceeds to step S505. In step S505, the CPU 103 shifts the detection region a predetermined number of pixels to the right, for example, 4 pixels, and the processing returns to step S502.

Meanwhile, in step S506, the CPU 103 saves in the RAM 104 the line result that is saved in the RAM 104 as the amount of applied toner for the line, and ends the processing.

Next, a flowchart 602 illustrating processing for detecting the amount of applied toner (step S402) in a case of 4-times scaling according to an embodiment will be described. There are differences in step S601 and step S605 as compared to the normal-case amount of applied toner detection processing. Accordingly, only these differences will be described.

Firstly, in step S601, the CPU 103 sets an 8×1 pixel detection region to the left edge of the image in an image corresponding to the inputted bitmap-format image data.

In step S605, the CPU 103 shifts the detection region a predetermined number of pixels to the right, for example, 2 pixels, and the processing returns to step S502. Because other steps are the same as in the normal-case line-unit amount of applied toner detection processing, description is omitted.

<Image Transfer Processing>

Figure 9:
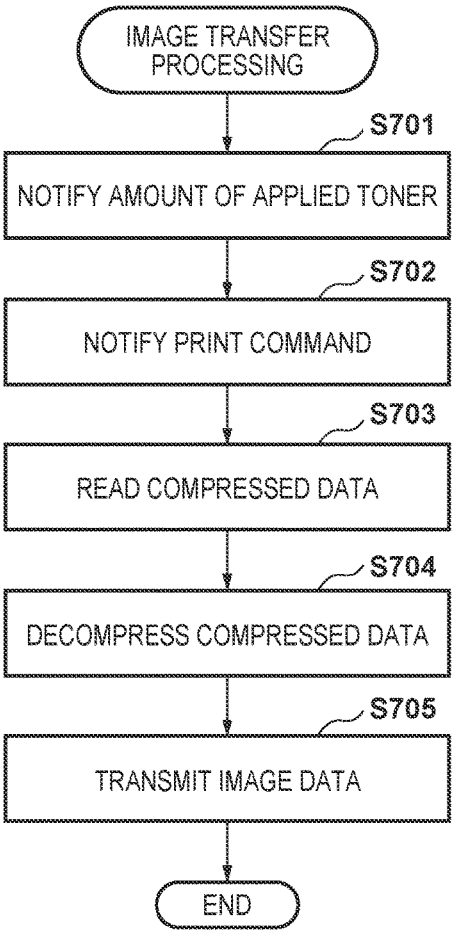
FIG. 9 is a flowchart illustrating image transfer processing according to an embodiment.

Next, with reference to FIG. 9, a processing procedure for image transfer processing according to the present embodiment is described. The processing described below is realized by the CPU 103 reading a control program stored in the ROM 102 or the external storage apparatus 123 into the RAM 104 and executing it.

Firstly, in step S701, the CPU 103 transmits an amount of applied toner held on the external storage apparatus 123 via the printer I/F 113 to the printer 122. Next, in step S702, the CPU 103 transmits an image forming command via the printer I/F 113 to the printer 122.

After that, in step S703, the CPU 103 temporarily saves on the RAM 104 compressed output image data that is held in the external storage apparatus 123 when it receives an image transfer request via the printer I/F 113 from the printer 122. Next, the CPU 103 while decompressing the compressed output image data in step S704, transmits the decompressed image data via the printer I/F 113 to the printer 122 in step S705. When the transmission completes, the processing ends.

<Image Formation Processing>

Figure 10:
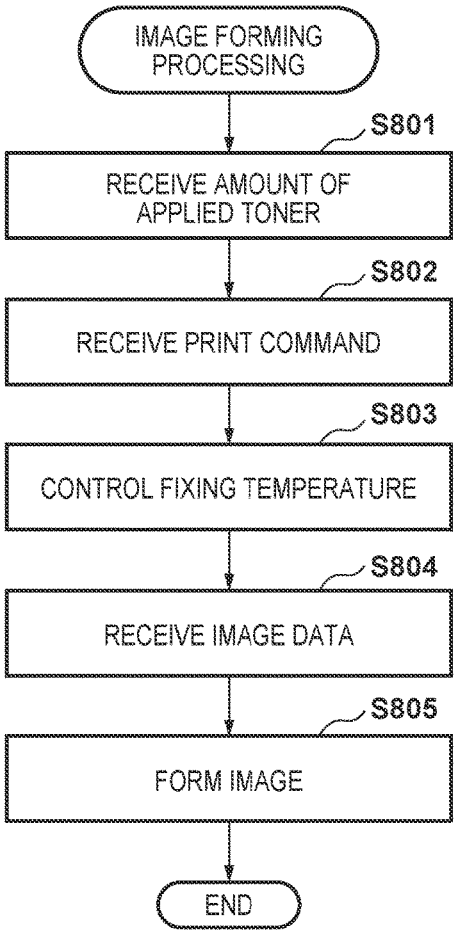
FIG. 10 is a flowchart illustrating image formation processing according to an embodiment.

Next, with reference to FIG. 10, a processing procedure for image formation processing according to the present embodiment is described. The processing described below is executed by the printer 122.

Firstly, in step S801, the printer 122 receives the amount of applied toner transmitted via the printer I/F 113 from the CPU 103. In step S802, the printer 122 receives the image forming command transmitted via the printer I/F 113 from the CPU 103. In step S803, the printer 122 performs control of the fixing temperature/the fixing speed of the fixing apparatus in accordance with the received image forming instruction and amount of applied toner.

Next, in step S804, the printer 122 outputs an image transfer request via the printer I/F 113 to the controller 101. After that, the printer 122 receives CMYK-format image data for which pseudo halftone processing has been performed and which is transmitted via the printer I/F 113 from the controller 101 in accordance with the image transfer request. Finally, in step S805, the CPU 103 performs image formation and sheet conveyance control, executes image formation processing, and ends the processing.

<Time for Detection>

Figure 11:
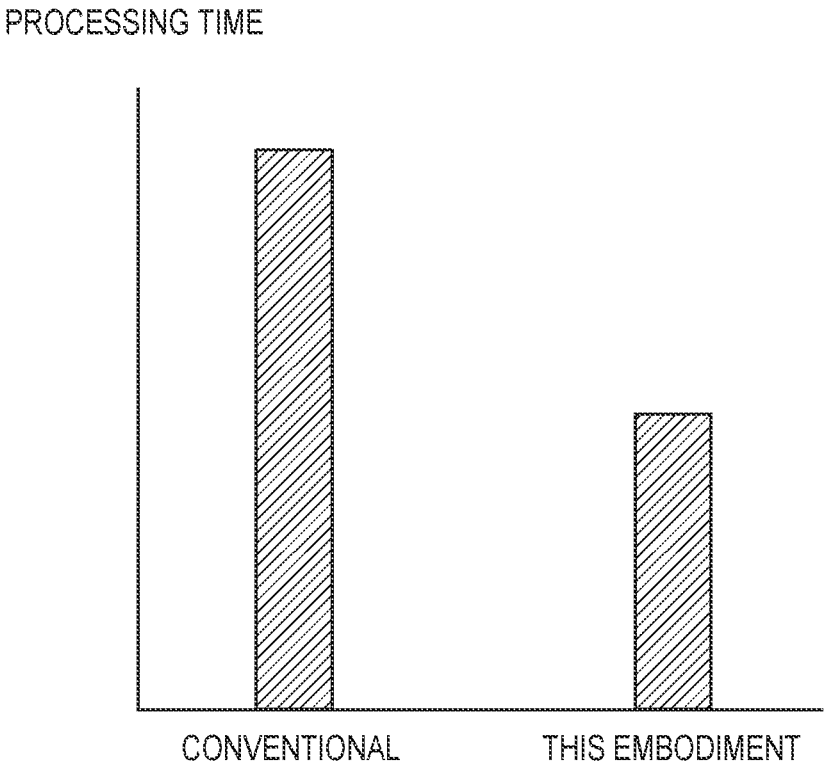
FIG. 11 is a view illustrating an effect regarding time for detecting an amount of applied toner according to an embodiment.

Next, with reference to FIG. 11, the time for detecting the amount of applied toner according to an embodiment will be described. In FIG. 11, the ordinate axis indicates processing time, and the processing time according to a conventional method and the processing time according to the method of the present embodiment are illustrated. In time for detecting the amount of applied toner, a large part of the processing is processing for reading the image data from the RAM 104. Once the image data is read out, it can be obtained thereafter using a cache in the CPU 103, and therefore the time for detecting the amount of applied toner depends on the image data size.

Accordingly, when image data scaling (magnification) processing is executed prior to detection of the amount of applied toner, the image data grows, and the image data read time grows proportionally. Accordingly, in the present application invention, if a predetermined scaling ratio is exceeded, the amount of applied toner detection processing is executed using the image data which is of a small data size prior to the scaling (magnification).

Accordingly, as illustrated in FIG. 11, if there is image data magnification processing, the size of the image data when detecting the amount of applied toner is smaller in the present embodiment compared to in conventional configurations, and so it is possible to shorten the time for detecting the amount of applied toner. In this way, by virtue of the present embodiment, even if image formation (printing, copying, or the like) is performed for a large size image, it is possible to enable high productivity image formation while performing control of the fixing apparatus in accordance with the amount of applied toner because the amount of applied toner is obtained in relation to an image prior to magnification.

Other Embodiments

Various variations of the present invention are possible, and it is not limited to the foregoing embodiment. For example, in the foregoing embodiment, a case of image formation processing on image data that is input via the network I/F 114 was described, but the present invention is not limited thereto. For example, it is possible to apply the present invention to image formation processing for image data that is inputted by a reception of a FAX or image data that is generated in the image forming apparatus by copy processing, PG, report printing or the like and saved.

Also, in the foregoing embodiment, a case of image formation processing of JPEG image data was described, but the present invention is not limited thereto. For example, it can also be applied to PDF format image data, PDL format image data, or the like. In the case of such image data, the amount of applied toner detection processing is executed after converting to a bitmap format image by the CPU 103.

Also, in the foregoing embodiment, a case of 4-times scaling was described as the amount of applied toner detection processing in the case of scaling, but the present invention is not limited thereto. For example, processing for detecting the amount of applied toner may be arranged separately for the case of 2-times scaling, the case of 1.5-times scaling or the like.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-103616 filed on May 24, 2016, which is hereby incorporated by reference herein in its entirety.

What is claimed is:

1. An image forming apparatus, comprising:

a memory device that stores a set of instructions; and at least one processor that executes the instructions to:

determine whether or not a scaling degree in a processing of inputted image data exceeds a predetermined threshold, and in a case where it is determined that the scaling degree of the inputted image data does not exceed the predetermined threshold, execute processing for scaling the inputted image and then execute first prediction processing that predicts an amount of applied toner using image data after scaling, and in a case where it is determined that the scaling degree of the inputted image data exceeds the predetermined threshold, execute second prediction processing that predicts the amount of applied toner using the inputted image data prior to scaling and then execute scaling processing after executing the second prediction processing.

2. The image forming apparatus according to claim 1, wherein the at least one processor further executes the instructions to, in the first prediction processing and the second prediction processing, obtain an amount of applied toner for each predetermined prediction region including a plurality of pixels in an image corresponding to image data, and obtain a maximum amount of applied toner in a region including all of the pixels of the image.

3. The image forming apparatus according to claim 2, wherein the at least one processor further executes the instructions to obtain an amount of applied toner for each line using the predetermined prediction region.

4. The image forming apparatus according to claim 3, wherein the at least one processor further executes the instructions to, in the first prediction processing and the second prediction processing, in order to obtain the amount of applied toner for each line, obtain an amount of applied toner in the lines by repeatedly, after predicting the amount of applied toner of the predetermined prediction region that is set, shifting the predetermined prediction region by a predetermined number of pixels and then obtaining the amount of applied toner.

5. The image forming apparatus according to claim 4, wherein the predetermined number of pixels for the second prediction processing is smaller than the predetermined number of pixels for the first prediction processing.

6. The image forming apparatus according to claim 5, wherein the predetermined number of pixels of the first prediction processing is 4 pixels, and the predetermined number of pixels of the second prediction processing is 2 pixels.

7. The image forming apparatus according to claim 2, wherein the predetermined prediction region for the second prediction processing is smaller than the predetermined prediction region for the first prediction processing.

8. The image forming apparatus according to claim 7, wherein the predetermined prediction region of the first prediction processing is 16×1 pixels, and the predetermined prediction region of the second prediction processing is 8×1 pixels.

9. The image forming apparatus according to claim 1, further comprising:

an image forming unit configured to form an image on a recording material based on the inputted image data; and a fixing unit configured to cause the image that is formed by the image forming unit to be fixed onto the recording material by controlling a fixing temperature based on the predicted amount of applied toner.

10. The image forming apparatus according to claim 1, wherein the at least one processor further executes the instructions to transmit the predicted amount of applied toner and image data to an external apparatus.

11. The image forming apparatus according to claim 1, wherein the scaling degree is a scaling ratio in the processing of inputted image data.

12. A method of controlling an image forming apparatus, the image forming apparatus comprising a memory device that stores a set of instructions; and at least one processor that executes the instructions, the method comprising:

determining whether or not a scaling degree in a processing of inputted image data exceeds a predetermined threshold, and in a case where it is determined that the scaling degree of the inputted image data does not exceed the predetermined threshold, executing processing for scaling the inputted image and then executing first prediction processing that predicts an amount of applied toner using image data after scaling, and in a case where it is determined that the scaling degree of the inputted image data exceeds the predetermined threshold, executing second prediction processing that predicts the amount of applied toner using the inputted image data prior to scaling and then executing scaling processing after executing the second prediction processing.

13. A non-transitory computer readable storage medium for storing a program for causing a computer to execute each step of a method of controlling an image forming apparatus, the image forming apparatus comprising a memory device that stores a set of instructions; and at least one processor that executes the instructions, the method comprising:

determining whether or not a scaling degree in a processing of inputted image data exceeds a predetermined threshold, and in a case where it is determined that the scaling degree of the inputted image data does not exceed the predetermined threshold, executing processing for scaling the inputted image and then executing first prediction processing that predicts an amount of applied toner using image data after scaling, and in a case where it is determined that the scaling degree of the inputted image data exceeds the predetermined threshold, executing second prediction processing that predicts the amount of applied toner using the inputted image data prior to scaling and then executing scaling processing after executing the second prediction processing.

* * * * *